US010057943B2

(12) United States Patent
Jeon et al.

(10) Patent No.: US 10,057,943 B2
(45) Date of Patent: Aug. 21, 2018

(54) ELECTRODE FOR CARBON FIBER PLATE HEATING ELEMENT AND METHOD FOR PRODUCING THE SAME

(71) Applicants: Hyundai Motor Company, Seoul (KR); KWANG JIN WINTEC CO., LTD., Busan (KR)

(72) Inventors: Sang Soo Jeon, Gyeonggi-do (KR); Tae Seung Lee, Gyeonggi-do (KR); Gyu Jin Shin, Seoul (KR)

(73) Assignees: Hyundai Motor Company, Seoul (KR); KWANG JIN WINTEC CO., LTD., Busan (KR)

( * ) Notice: Subject to any disclaimer, the term of this patent is extended or adjusted under 35 U.S.C. 154(b) by 673 days.

(21) Appl. No.: 14/330,315

(22) Filed: Jul. 14, 2014

(65) Prior Publication Data

US 2015/0163856 A1 Jun. 11, 2015

(30) Foreign Application Priority Data

Dec. 10, 2013 (KR) ..... 10-2013-0153260

(51) Int. Cl.

| | |
|---|---|
| ***H05B 1/02*** | (2006.01) |
| ***H01C 17/02*** | (2006.01) |
| ***H01C 17/04*** | (2006.01) |
| ***H05B 3/36*** | (2006.01) |
| ***H05B 3/14*** | (2006.01) |

(Continued)

(52) U.S. Cl.

CPC ..... *H05B 1/0238* (2013.01); *H01C 17/02* (2013.01); *H01C 17/04* (2013.01); *H05B 3/145* (2013.01); *H05B 3/20* (2013.01); *H05B 3/34* (2013.01); *H05B 3/36* (2013.01); *H05B 2203/016* (2013.01); *H05B 2203/029* (2013.01); *Y10T 29/49083* (2015.01)

(58) Field of Classification Search

None

See application file for complete search history.

(56) References Cited

U.S. PATENT DOCUMENTS 4,820,012 A * 4/1989 Asai ..... G02B 6/4416 174/113 C
4,983,814 A * 1/1991 Ohgushi ..... D02G 3/441 219/212

(Continued)

FOREIGN PATENT DOCUMENTS

JP 11283731 10/1999
JP 2007-299933 A 11/2007

(Continued)

*Primary Examiner* — Joseph M Pelham

(74) *Attorney, Agent, or Firm* — Mintz Levin Cohn Ferris Glovsky and Popeo, P.C.; Peter F. Corless

(57) ABSTRACT

A carbon fiber plate heating element and a method for producing the same are provided. The carbon fiber plate heating element includes a core wire positioned at a substantial center and an electrode body that includes a plurality of electrode fine lines twisted around the core wire. A stitching portion fixes the electrode body to a main panel at regular intervals. The method includes arranging a core wire at the substantial center; twisting a plurality of electrode fine lines around the core wire to form an electrode body; and fixing the electrode body to a main panel by stitching the electrode body at regular intervals.

5 Claims, 4 Drawing Sheets

(51) Int. Cl.
*H05B 3/20* (2006.01)
*H05B 3/34* (2006.01)

(56) References Cited

U.S. PATENT DOCUMENTS

| | | | | |
|---|---|---|---|---|
| 6,888,112 | B2 * | 5/2005 | Rock | A41D 13/0051 219/211 |
| 8,288,693 | B2 | 10/2012 | Weiss et al. | |
| 2007/0278210 | A1 * | 12/2007 | Weiss | B60N 2/5685 219/508 |
| 2007/0278214 | A1 * | 12/2007 | Weiss | H05B 3/342 219/545 |
| 2008/0290080 | A1 * | 11/2008 | Weiss | H05B 1/0238 219/202 |
| 2010/0044075 | A1 * | 2/2010 | Weiss | H01B 1/22 174/126.2 |
| 2011/0074380 | A1 * | 3/2011 | Jeon | D03D 13/00 323/318 |
| 2011/0297667 | A1 * | 12/2011 | Kunisada | H01C 3/06 219/549 |
| 2012/0013433 | A1 * | 1/2012 | Rauh | H05B 3/34 338/296 |
| 2015/0373782 | A1 * | 12/2015 | Kang | H05B 3/34 219/541 |

FOREIGN PATENT DOCUMENTS

| | | | | |
|---|---|---|---|---|
| JP | 5543034 | B2 * | 7/2014 | H05B 3/345 |
| KR | 10-2011-0121759 | | 11/2011 | |
| KR | 10-2012-0039370 | | 4/2012 | |
| KR | 10-2013-0000193 | A | 1/2013 | |
| KR | 10-1233393 | B1 | 2/2013 | |
| KR | 10-2013-0108954 | A | 10/2013 | |

* cited by examiner

ELECTRODE FOR CARBON FIBER PLATE HEATING ELEMENT AND METHOD FOR PRODUCING THE SAME

CROSS REFERENCE TO RELATED APPLICATION

The present application claims priority of Korean Patent Application Number 10-2013-0153260 filed Dec. 10, 2013, the entire contents of which application is incorporated herein for all purposes by this reference.

TECHNICAL FIELD

The present invention relates to an electrode for a carbon fiber plate heating element and a method for producing the same, which reduces a defect rate of an electrode during manufacturing processes of a plate heating element and improve physical durability of an electrode, thereby improving product quality.

BACKGROUND

For a heating element for a heated seat of a vehicle, metallic heating elements, such as nichrome wire, iron wire, nickel wire, silver-plated copper wire, have been typically used. Since these metallic heating elements have substantially low specific resistance, there is risk of fire when an over-current flows in the metallic heating elements. Furthermore, since the metallic heating elements are usually configured with series of connected coils, electrical disconnection may occur.

As an alternative according to such problems, a plate heating element in which carbon fiber is used as a resistance heating element and the resistance heating elements are connected in parallel may be used. The plate heating element using carbon fiber may be obtained by weaving strands of carbon fiber into a radial pattern and connecting various forms of electrodes arranged in parallel to each end of the pattern using a fixing thread. When electric power is applied to the electrodes, the carbon fiber generates heat.

The carbon fiber plate heating element has the advantages, for example, low power consumption, a thermal comfort through surface heating, and high heating rate compared to a linear metallic wire heating element. However, the heating element for a heated seat may be expensive, and the lifetime of the heating element may depend on durability of the electrodes arranged at each end of a carbon fiber-woven mat and the adhesive stability of the electrodes. Although some conventional electrodes have configured to improve the durability, improvement in durability of the electrodes in conventional arts may be limited to a pattern in arrangement of the electrodes.

Therefore, the present invention may include changing the shape and structure of an electrode used for a carbon fiber plate heating element, to reduce a defect rate of the electrode during manufacturing processes and to improve physical durability of the electrode, thereby leading to an improved quality of products.

In a conventional art, a plate heating seat and a method for manufacturing the same have been developed. For example, a first power line of a lace shape and a second power line of a linear shape are attached in parallel to each end of a main seat, and multiple rows of carbon fiber are woven into a variety of patterns using a loom or knitting machine and attached to the main seat. Meanwhile, such conventional art may cause a misalignment when the power lines of the carbon fiber heating element are fixed to predetermined portions of the main seat and materials may be wasted when the woven power lines are cut into desired sizes whenever they are used.

In some related arts, a method may include a process of bonding electric wires on a main seat using a hot-melt adhesive, and thus an additional cost may incur. Further, in other cases, electric wires may be linearly arranged; therefore, seats and heating elements may not be flexible in design. In another example of the conventional methods, electrodes constituting the electric wire may be linearly arranged; therefore the electrodes may be deteriorated in tensile strength and durability due to repeated seating by a user.

The foregoing is intended merely to aid in the understanding of the background of the present invention, and is not intended to mean that the present invention falls within the purview of the related art that is already known to those skilled in the art.

SUMMARY

The present invention provides a technical solution to above-referred problems occurring in the related art, and in particular, the present invention provides a carbon fiber plate heating element and a method for producing the same which may reduce a defect rate of an electrode during manufacturing processes of the plate heating element and may improve physical durability of the electrode, thereby improving product quality.

In one aspect of the present invention, a carbon fiber plate heating element may include a core wire positioned at the center, an electrode body including a plurality of electrode fine lines which are twisted around the core wire, and a stitching portion which fixes the electrode body to a main panel at regular intervals. The core wire may include aramid-, polybenzoxazole (PBO)-, or polypenylenesulfide (PPS)-based tension fiber. The electrode fine line may be a copper wire plated with, but not limited to, silver or nickel. The electrode body may be obtained by twisting a plurality of electrode bunches around the core wire and each electrode bunch may be obtained by twisting a plurality of the electrode fine lines. The electrode body may be configured such that the plurality of the electrode fine lines are arranged in parallel at regular intervals on the main panel and may be bent in a sine wave form.

In another aspect of the present invention, a method for producing a carbon fiber plate heating element may include: arranging a core wire at the substantial center; twisting a plurality of electrode fine lines around the core wire, to form an electrode body; and fixing the electrode body to a main panel by stitching the electrode body at regular intervals. In particular, in the twisting process, the plurality of electrode fine lines may be twisted to form an electrode bunch, and a plurality of the electrode bunches may be twisted around the core wire to form the electrode body. The method may further include arranging a plurality of the electrode bodies on the main panel at regular intervals and bending the electrode bodies in a sine wave form and the arranging may be performed after the twisting process.

In exemplary embodiments of the present invention, each electrode line may have a diameter of about 50 μm in contrast to conventional electrodes having a diameter of 70 μm, and may be plated with, but not limited to, silver (Ag) or nickel (Ni). Thus, flexibility and corrosion resistance of the electrode may be improved. Moreover, in another exemplary embodiments, the core wire may include aramid-, polybenzoxazole (PBO)-, or polypenylenesulfide (PPS)-based tensile strength-reinforced core fiber having high rigidity. Further, the double twist structure may be used for the electrode line, thereby improving tensile strength and durability of the electrode line.

In addition, the electrode lines may be fixed using stitching machine, and therefore, breaking and cutting of the electrode lines may be prevented using double twist structure and adjusting twist number when the electrode lines are stitched. In addition, bending characteristics and bending durability may be improved compared to conventional electrode technologies. Furthermore, since the electrode lines may be fixed through stitching, the electrode lines having a sine wave form may be maintained in regular intervals therebetween. Since the electrode lines of the carbon fiber plate heating element may be directly fixed using a stitching machine, the electrode lines may be precisely positioned in predetermined positions. Further since the electrode lines may be directly stitched onto the main seat (e.g., fabric) without preparing bands of electrode lines, fabrication cost may be reduced, and electrode terminals conforming to the shapes of various foam pads for seats and to the shapes of curved regions of seats may be obtained.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinbelow, exemplary embodiments of the present invention will be described in detail with reference to the accompanying drawings.

Figure 1:
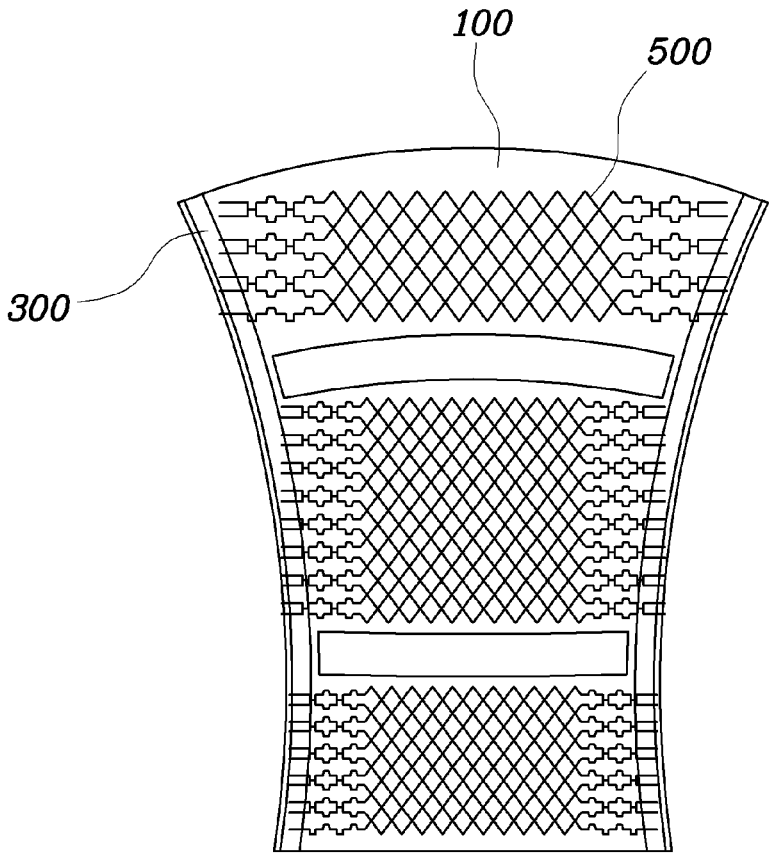
FIGS. 1 to 2 show exemplary views of an electrode of a carbon fiber plate heating element according to an exemplary embodiment of the present invention.
Figure 2:
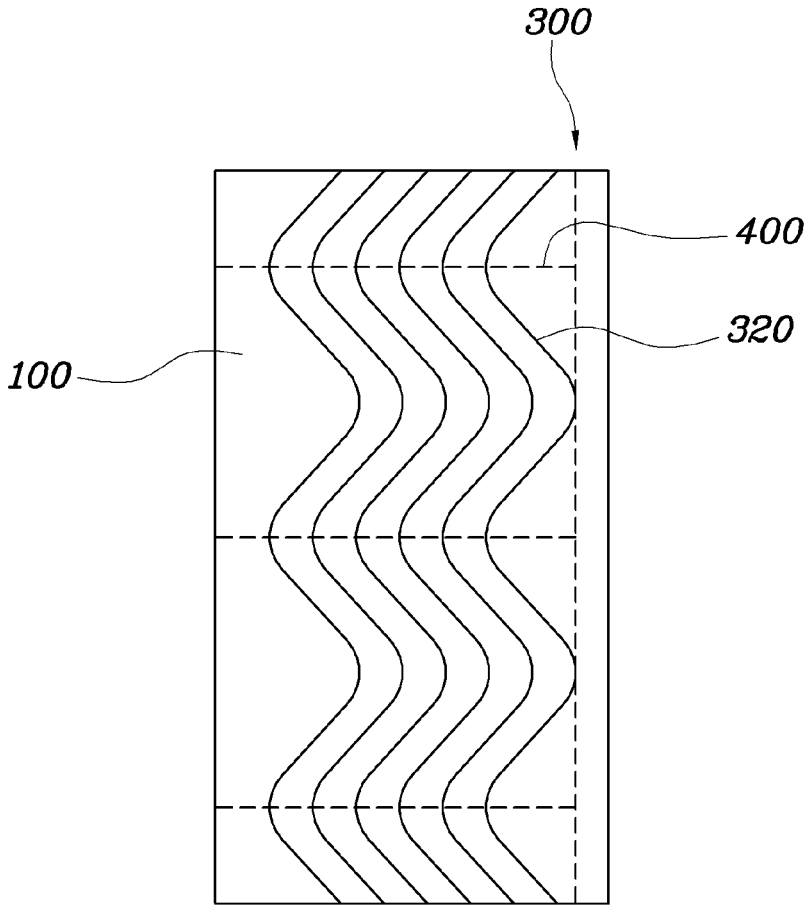
Figure 3:
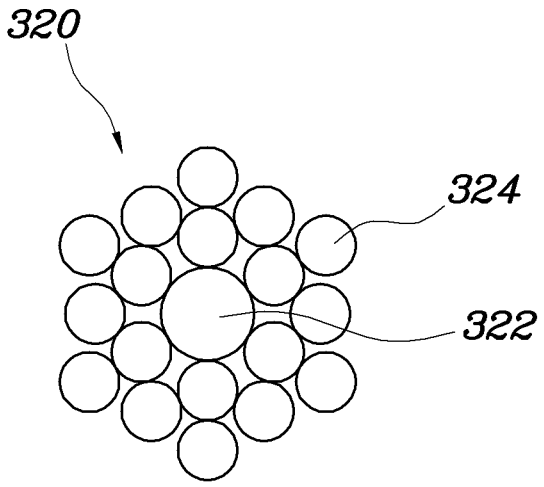
FIG. 3 shows an exemplary cross-sectional view of the electrode of the carbon fiber plate heating element according to an exemplary embodiment of the present invention.
Figure 4:
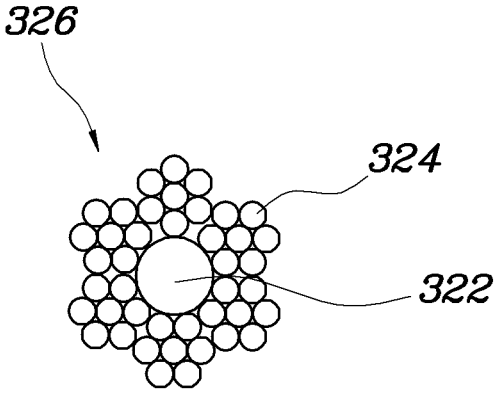
FIG. 4 shows an exemplary cross-sectional view of an electrode of a carbon fiber plate heating element according to another exemplary embodiment of the present invention.

FIGS. 1 to 2 are exemplary views of an electrode of a carbon fiber plate heating element according to an exemplary embodiment of the present invention; FIG. 3 is an exemplary cross-sectional view of the electrode of the carbon fiber plate heating element according to an exemplary embodiment of the present invention; FIG. 4 is an exemplary cross-sectional view of an electrode of a carbon fiber plate heating element according to another exemplary embodiment of the present invention; and FIG. 5 shows an exemplary flowchart of manufacturing an electrode of a carbon fiber plate heating element according to an exemplary embodiment of the present invention.

In FIG. 1 which shows the carbon fiber plate heating element of an exemplary embodiment, the electrodes may be installed at each side of a main panel arranged on a surface of a vehicle seat. The electrodes may be connected to each other by carbon fiber so that the seat may function as a heated seat. In particular, the electrode of the carbon fiber plate heating element may include: a core wire 322 located in a substantially center position; an electrode body 320 including a plurality of electrode fine lines 324 twisted around the core wire 322; and a stitching portion 400 configured to fix the electrode 320 to a main panel 100 at regular intervals. In the carbon fiber plate heating element according to another exemplary embodiment as illustrated in FIG. 3, an electrode body 320 may have a core wire 322 in the substantially center position. In the electrode body 320, a plurality of electrode fine lines 324 may be twisted around the core wire 322. In another exemplary embodiment, as illustrated in FIG. 2, the electrode body 320 may be stitched and fixed to a main panel 100 via a stitching portion 400. The core wire 322 may include aramid-based, polybenzoxazole (PBO)-based, or polypenylenesulfide (PPS)-based tension fiber. The electrode fine lines 324 may be copper wires plated with, but not limited to, silver or nickel. As illustrated in FIG. 4, the electrode body 320 may be obtained by twisting a plurality of electrode bunches 326 around the core wire 326, and each of the electrode bunch 326 may be obtained by twisting a plurality of the electrode fine lines 324. Multiple electrode bodies 320 may be arranged at regular intervals on the main panel 100 as illustrated in FIG. 2, and may be bent in a sine wave form.

Figure 5:
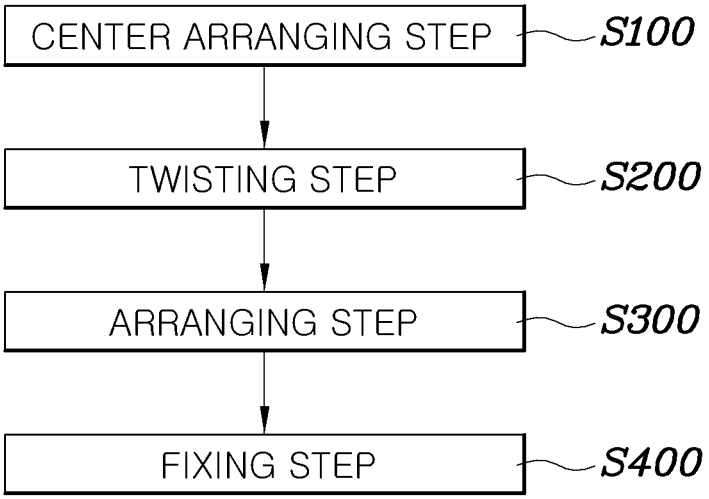
FIG. 5 shows an exemplary flowchart of a method for manufacturing an electrode of a carbon fiber plate heating element according to an exemplary embodiment of the present invention.

In another aspect, as shown in FIG. 5, a method for manufacturing the carbon fiber plate heating element may include: arranging a core wire in a center position (S100); twisting a plurality of electrode fine lines around the core wire to form an electrode body (S200); and stitching the electrode body with a main body at regular intervals (S400).

In particular, in the twisting process (S200), a plurality of the electrode fine lines may be twisted to form an electrode bunch, and then a plurality of the electrode bunches may be twisted around the core wire to form the electrode body. After the twisting step (S200), an arranging process (S300) of arranging a plurality of electrode bodies on the main panel at regular intervals in such a manner that the electrode bodies may be bent in a sine wave form may be included. In addition, the core wire may include aramid-, polybenzoxazole (PBO)-, or polypenylenesulfide (PPS)-based tension-reinforced core fiber having substantially high strength to increase durability for tensile stress. Furthermore, the copper electrode fine lines may be plated with, but not limited to, silver or nickel to improve corrosion resistance.

In an exemplary embodiment, the electrode fine line may have a reduced diameter of about 50 μm in contrast to the conventional electrode fine lines having a diameter of 70 μm. Therefore, the electrode fine line of the present invention may have improved bending durability. Furthermore, about 5 to 9 strands of fine lines may be twisted to form a bunch of fine lines and subsequently, about 4 to 7 bunches of fine lines may be twisted to form a double twist electrode. Therefore, the electrode may have improved tensile and bending durability.

According to one example of conventional arts, a lace of electrode lines is prepared and then the lace is attached to a piece of non-woven fabric. Accordingly, the lace type electrode may be just slightly bent to the extent that the electrode lines may be barely arranged on the fabric. As consequence, the conventional electrodes lines may be too stiff to be easily bent. To the contrary, according to an exemplary embodiment of the present invention, the electrode lines may be bent in various forms, thereby conforming to the shape of a foam pad of a seat for a vehicle.

Furthermore, according to the method of arranging the electrode lines on fabric in one exemplary embodiment of the present invention, since the method may include a stitching process while the conventional method may include attaching electrode strips, adhesive stability and durability may be improved. In particular, bending electrode lines may be a necessary technique to improve physical durability and adhesive stability of carbon fiber. In contrast, according to conventional arts, the electrode lines are integrated, electrodes or needles may break when carbon fiber is woven. However, when stitching machine is used according to an embodiment of the present invention, the electrode lines may be bent in a sine wave form and a constant interval between the electrode lines may be maintained.

In yet another exemplary embodiment, the electrodes may have a double twist structure and a twist number of the electrode may be in the range of about 5 to 20 twists per inch (TPI) to arrange the electrodes on fabric using stitching machine. When the twist number is less than 5 TPI, the electrode may break when a needle penetrates the electrode or the electrode is stitched to fabric. On the other hand, when the twist number is 20 or greater, the tensile strength of the electrode may decrease. After the carbon fiber plate heating element is obtained, tests for evaluating physical properties were performed. For example, bending tests have shown that the tensile strength is increased to about 401 N and durability is improved to about 900000 times. Further, Z-direction folding tests have shown that the strength is improved to about 900000 times. In the test for tensile strength, the electrode line was folded to left and right to about 90° several times under a load of about 880 g. At the time of folding test, the electrode line was folded several times such that each opposite end were approached each other and were separated from each other. In this test, the stroke was about 50 mm and folding was performed at about 90 rpm.

The carbon fiber plate heating element having the structure described above and the method for producing the same according to exemplary embodiments of the present invention may reduce a defect rate of an electrode during manufacturing processes of a plate heating element and improve physical durability of the electrode, thereby improving product quality. Furthermore, since each electrode line may have a reduced diameter of about 50 μm in contrast to conventional electrode lines having a diameter of 70 μm, and plated with silver (Ag) or nickel (Ni), flexibility and corrosion resistance of the electrode may be improved. Moreover, since aramid-, polybenzoxazole (PBO)-, or polypenylenesulfide (PPS)-based tensile strength-reinforced core fiber having high rigidity and the double twist structure may be used for the electrode line, the electrode line may be improved in tensile strength and durability.

In addition, the electrode lines may be fixed using stitching machine, and breaking and cutting of the electrode lines may be prevented by using double twist structure and adjusting twist number when the electrode lines are stitched. Further, bending characteristics and bending durability of the electrode lines may be improved compared to conventional electrode technologies. Furthermore, since the electrode lines are fixed through stitching, the electrode lines having a sine wave form may be maintained in regular intervals therebetween. Moreover, since the electrode lines of the carbon fiber plate heating element may be directly fixed using a stitching machine, the electrode lines may be more precisely positioned in predetermined locations. Since the electrode lines may be directly stitched onto the main seat (fabric) without preparing bands of electrode lines, production cost may be reduced and electrode terminals conforming to the shapes of various foam pads of seats and the shapes of curved regions of seats may be obtained.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An electrode of a carbon fiber plate heating element, wherein the electrode is installed at a main panel, the electrode comprising:

a core wire positioned at a substantial center of an electrode body;

a plurality of electrode wires twisted around the core wire; and a stitching portion configured to fix the electrode body to the main panel at regular intervals, wherein the core wire is made from aramid-, polybenzoxazole (PBO)-, or polyphenylene sulfide (PPS)-based tension fiber, wherein the electrode body is obtained by twisting a plurality of electrode bunches around the core wire and each of the plurality of electrode bunches is obtained by twisting the plurality of electrode wires, wherein each of the plurality of electrode wires has a diameter of about 50 μm, wherein about 5 to 9 strands of the plurality of electrode wires are twisted to form one of the plurality of electrode bunches, and about 4 to 7 bunches of the plurality electrode bunches are twisted to form the electrode body having a double twist structure, and wherein a twist number of the electrode body is in a range of 5 to 20 twists per inch (TPI).

2. The electrode of a carbon fiber plate heating element according to claim 1, wherein the electrode wire is a copper wire plated with silver or nickel.

3. The electrode of a carbon fiber plate heating element according to claim 1, wherein the plurality of the electrode wires are arranged in parallel on the main panel at regular intervals and are bent in a sine wave form.

4. A method for producing an electrode of a carbon fiber plate heating element, wherein the electrode is to be installed at a main panel, comprising:

arranging a core wire at a substantial center;

twisting a plurality of electrode wires around the core wire to form an electrode body; and fixing the electrode body to the main panel by stitching the electrode body at regular intervals, wherein the core wire is made from aramid-, polybenzoxazole (PBO)-, or polyphenylene sulfide (PPS)-based tension fiber, wherein in the twisting, the plurality of electrode wires are twisted to form an electrode bunch, and a plurality of electrode bunches is twisted around the core wire, to form the electrode body, wherein each of the plurality of electrode wires has a diameter of about 50 μm, wherein about 5 to 9 strands of the plurality of electrode wires are twisted to form one of the plurality of electrode bunches, and about 4 to 7 bunches of the plurality electrode bunches are twisted to form the electrode body having a double twist structure, and wherein a twist number of the electrode body is in a range of 5 to 20 twists per inch (TPI).

5. The method according to claim 4, further comprising:

arranging a plurality of the electrode bodies on the main panel at regular intervals and bending the electrode bodies in a sine wave form, wherein the arranging is performed after the twisting.

* * * * *